US006003825A

United States Patent [19]

Abernathy, Jr.

[11] Patent Number: 6,003,825

[45] Date of Patent: Dec. 21, 1999

[54] ADJUSTABLE WALL HANGING DEVICE

[76] Inventor: Henry H. Abernathy, Jr., 33 Constitution Hill West, Princeton, N.J. 08540

[21] Appl. No.: 09/086,314

[22] Filed: May 27, 1998

[51] Int. Cl.[6] ..... A47G 1/24

[52] U.S. Cl. ..... 248/478; 248/496

[58] Field of Search ..... 248/495, 477, 248/478, 496, 476, 475.1, 222.14, 223.31, 224.7, 225.11, 274.1, 295.11, 298.1, 287.1

[56] References Cited

U.S. PATENT DOCUMENTS

| | | | |
|---|---|---|---|
| 521,291 | 6/1894 | Lynch . | |
| 717,859 | 1/1903 | Jackson et al. . | |
| 779,433 | 1/1905 | Long . | |
| 791,060 | 5/1905 | Wallace | 248/496 |
| 904,690 | 11/1908 | Francis . | |
| 935,797 | 10/1909 | Leonard | 248/496 |
| 1,107,686 | 8/1914 | Mehrman . | |
| 1,229,221 | 6/1917 | Bugele | 248/274.1 |
| 1,951,583 | 3/1934 | Swanson | 248/477 |
| 2,139,309 | 12/1938 | Linden | 248/287.1 |
| 2,532,162 | 11/1950 | Goss . | |
| 2,681,194 | 6/1954 | Halvorsen . | |
| 2,696,962 | 12/1954 | Goss . | |
| 2,740,603 | 4/1956 | Wofford . | |
| 2,952,431 | 9/1960 | Pedley . | |
| 2,975,994 | 3/1961 | Goss | 248/496 |
| 2,987,832 | 6/1961 | Urbain et al. . | |
| 3,724,085 | 4/1973 | Wentworth . | |
| 4,033,539 | 7/1977 | Bardocz | 248/287.1 |
| 4,340,199 | 7/1982 | Brock . | |
| 4,892,284 | 1/1990 | Kelrick . | |
| 5,069,411 | 12/1991 | Murphy | 248/287.1 |
| 5,201,487 | 4/1993 | Epplet . | |
| 5,342,014 | 8/1994 | Wilson . | |
| 5,584,462 | 12/1996 | Reese . | |
| 5,732,912 | 3/1998 | Nomura et al. | 248/287.1 |
| 5,806,826 | 9/1998 | Lemire . | |

FOREIGN PATENT DOCUMENTS

| | | | |
|---|---|---|---|
| 197806 | 6/1978 | United Kingdom | 248/495 |

*Primary Examiner*—Derek J. Berger
*Assistant Examiner*—Michael Nornberg
*Attorney, Agent, or Firm*—David M. Quinlan

[57] ABSTRACT

An adjustable device for hanging a wire-supported object on a wall device comprises a first bar for attachment at to the wall in a horizontal position, a second bar perpendicular to the first bar and having a hook or hooks for accepting a wire secured to the object to be hung, and a connector with channels that hold the bars for sliding movement relative to each other. The first bar is secured to the wall at its ends and then the connector can be moved horizontally along the first bar and the second bar can be moved vertically within the connector. This permits the object to be positioned at precisely the desired position even after the hanger device is secured to the wall, unlike conventional devices that must be removed from the wall for repositioning. A spring-loaded pin on the connector is accepted into openings in the bars to lock them into the position that places the object on the desired position.

10 Claims, 3 Drawing Sheets

ADJUSTABLE WALL HANGING DEVICE

BACKGROUND OF THE INVENTION

1. Field of the Invention

The present invention relates to a wall hanging device, and more particularly, to a hanger that can be adjusted while in place on a wall.

2. Description of Background Art

Devices for hanging objects such as pictures on walls are well known in the prior art. There are even wall hanging devices that are adjustable to certain degrees. Examples of such devices are disclosed in the following U.S. patents:

| | |
|---|---|
| U.S. Pat. No. 521,291 | U.S. Pat. No. 2,681,194 |
| U.S. Pat. No. 717,859 | U.S. Pat. No. 2,740,603 |
| U.S. Pat. No. 779,433 | U.S. Pat. No. 2,952,431 |
| U.S. Pat. No. 904,690 | U.S. Pat. No. 5,584,462 |
| U.S. Pat. No. 1,107,686 | |

Prior art wall hanging devices generally fulfill their respective, particular objectives and requirements.

However, in hanging objects from a support structure (such as a wall) it would be advantageous if the hanging device could first be secured to the structure in the vicinity of a final desired position and then be capable of adjustment both horizontally and vertically to enable placement of the object at exactly the desired position, without requiring special adaptation of the object just to accommodate the hanging device.

For example, the above-listed patents disclose picture hangers, many of which enable vertical and horizontal adjustment of the position of the picture, but they require a special arrangement for attaching the picture to the object rather than permitting it to be hung on the device by a wire secured to the back of the picture in the conventional manner. One of the patents, U.S. Pat. No. 5,584,462, discloses a hanging device that is secured to a wall and permits mounting of a picture simply by hanging it on the device by such a wire. However, that device is adjustable only in the vertical direction.

SUMMARY OF THE INVENTION

In view of the foregoing disadvantages inherent in the known types of hanging devices now present in the prior art, the present invention provides a new adjustable hanger construction wherein the same can be utilized for hanging a conventionally constructed object from a structure such as a wall and adjusting the position of the object both vertically and horizontally.

It is another object of the present invention to provide a new adjustable wall hanger which may be easily and efficiently manufactured and marketed.

It is a further object of the present invention to provide a new adjustable wall hanger of a durable and reliable construction.

An even further object of the present invention is to provide a new adjustable wall hanger which is capable of low-cost manufacture with regard to both materials and labor, and which accordingly is then capable of being sold for a reasonable price to the consuming public, thereby making such adjustable wall hangers widely available to the public.

In its broadest aspects the present invention relates to a device for hanging an object on a supporting structure, which device comprises a first bar for affixing the device to the supporting structure, a second bar for supporting the object, and a connector movably supported by the first bar for adjustment of the position of the connector when the first bar is affixed to the supporting structure and movably supporting the second bar for relative movement transverse to the first bar when the first bar is affixed to the supporting structure, the connector including a fixing mechanism for securing the first bar and the second bar in fixed positions relative to each other after movement thereof to desired positions.

In accordance with another aspect of the invention, an adjustable device for hanging a wire-supported object on a wall comprises a first bar for positioning horizontally against the wall, which first bar includes attaching means allowing the first bar to be affixed to the wall at a desired location, a second bar having at least one hook for accepting a wire secured to the object to be hung, a connector connecting the first bar and the second bar for movement relative to each other, the connector including a first channel in which the first bar is mounted for permitting sliding movement of the connector along the first bar when the first bar is affixed to the wall and a second channel in which the second bar is mounted for sliding movement perpendicular to the first bar at a location displaced from the wall when the first bar is affixed to the wall, and a fixing mechanism on the connector for securing the first bar and the second bar in fixed positions relative to each other after movement thereof to desired positions.

For a better understanding of these and other objects of the invention, its operating advantages and the specific objects attained by its uses, reference should be had to the accompanying drawings and description of preferred embodiments of the invention that follows.

BRIEF DESCRIPTION OF THE DRAWINGS

The present invention will be better understood from the detailed description of its preferred embodiments which follows below, when taken in conjunction with the accompanying drawings, in which like numerals refer to like features throughout. This brief identification of the drawing figures will aid in understanding the detailed description that follows.

DETAILED DESCRIPTION OF THE PREFERRED EMBODIMENTS

Figure 1:
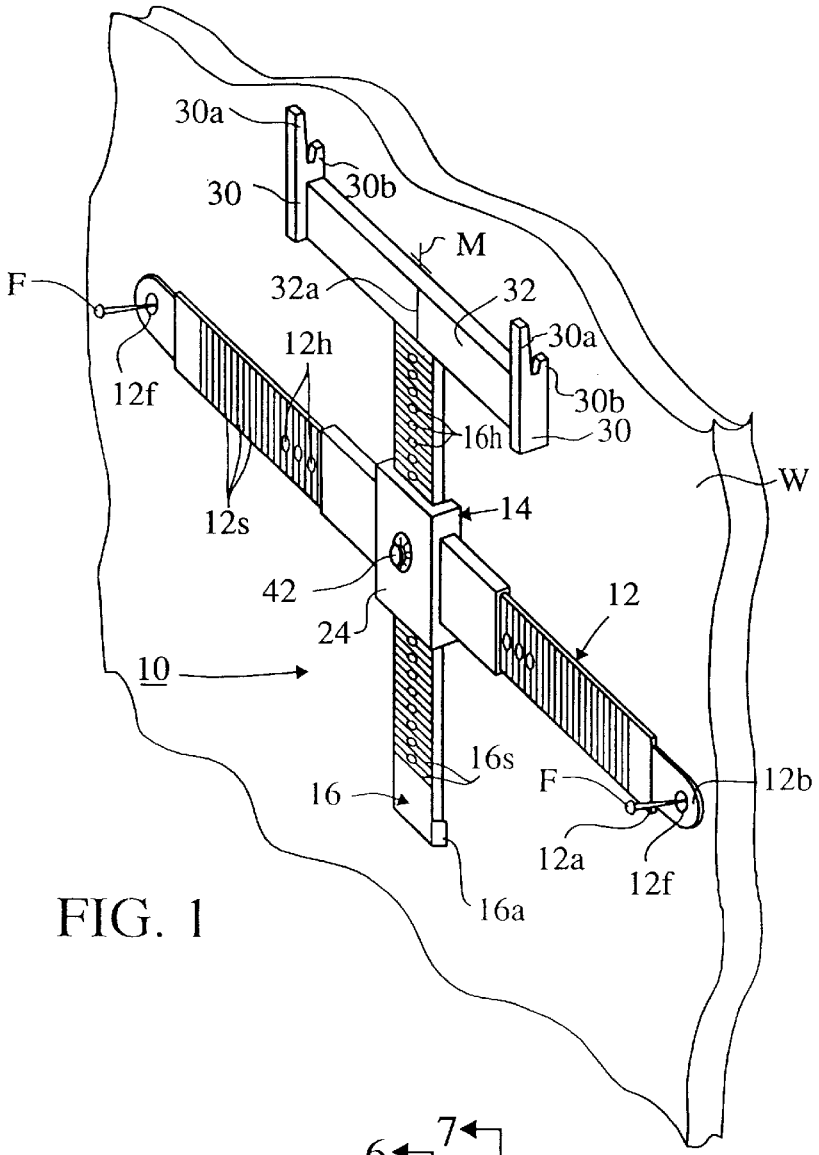
FIG. 1 is an isometric illustration of an adjustable wall hanger according to the present invention.

Before explaining particular embodiments of the present invention in detail, it is to be understood that the invention is not limited to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Referring now to FIG. 1, the adjustable wall hanger 10 includes a horizontal bar 12 for attaching the hanger 10 to a wall surface W. It is one of the important advantages of the present invention that the hanger 10 need not be attached to the wall at precisely the location it must be in to hang the object at its exactly desired location. As will be clear from the description that follows, the hanger can be adjusted once it is in place on the wall to precisely position the object being hung.

Figure 3:
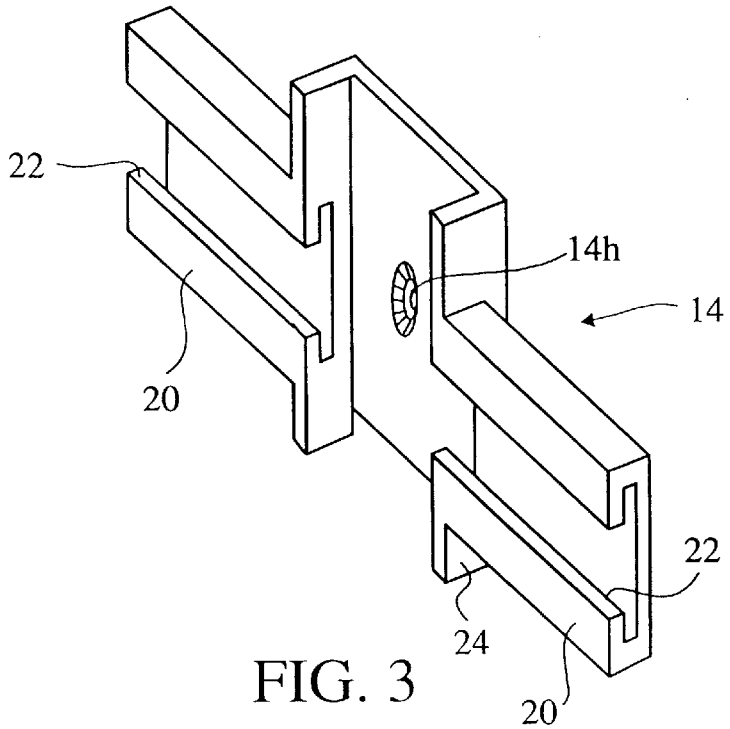
FIG. 3 is an isometric rear view of the connector of the wall hanger shown in FIG. 1.

A connector 14 slidably mounts the horizontal bar 12 to a vertical bar 16. The connector 14 receives the horizontal bar 12 and the vertical bar 16, which slides within the connector 14 above the horizontal bar 12. The connector 14, shown in more detail in FIG. 3, is comprised of a horizontal channel section 20 that accepts the horizontal bar 12, as shown in more detail in FIGS. 7 and 8. The horizontal bar 12 includes a top section 12*a* and a bottom section 12*b*. In the depicted embodiment the sections 12*a* and 12*b* are shown as separate pieces. However, it is within the scope of the invention to make them integral with each other, as by molding them in one piece.

The top section 12*a* fits within the horizontal channel section 20. The bottom section 12*b* has a width that is slightly narrower than a slot 22 that runs the length of the horizontal channel section 20 and it is slightly thicker than the walls of the channel section. In that fashion the horizontal bar 12 is captured by the channel section 20, but the connector can still slide longitudinally relative to the horizontal bar when it is affixed to the wall (see FIG. 8).

Figure 5:
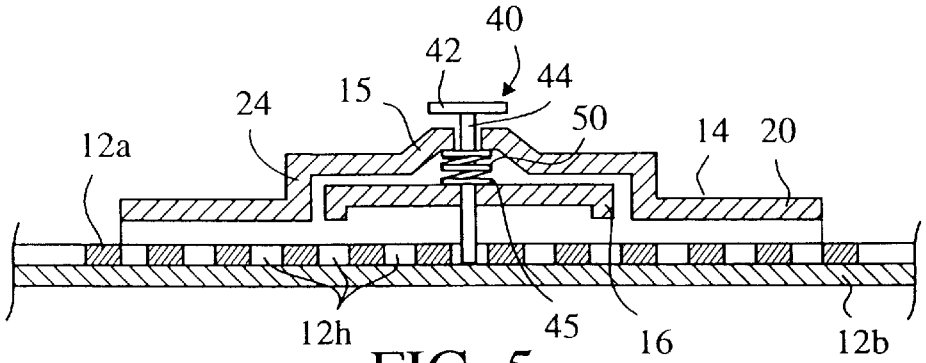
FIG. 5 is a detailed view of portion 5—5 in FIG. 4.
Figure 7:
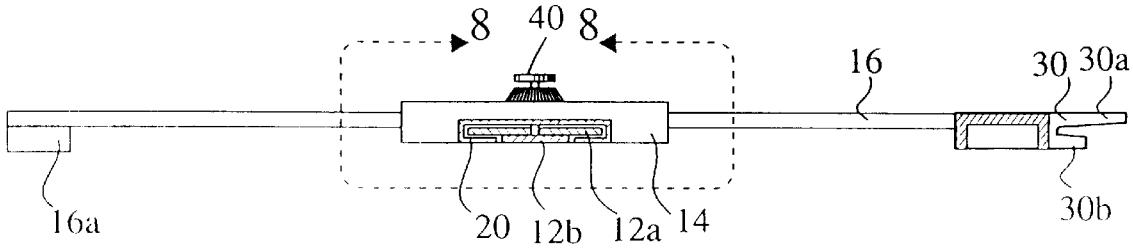
FIG. 7 is a cross-section taken through line 7—7 of FIG. 2
Figure 8:
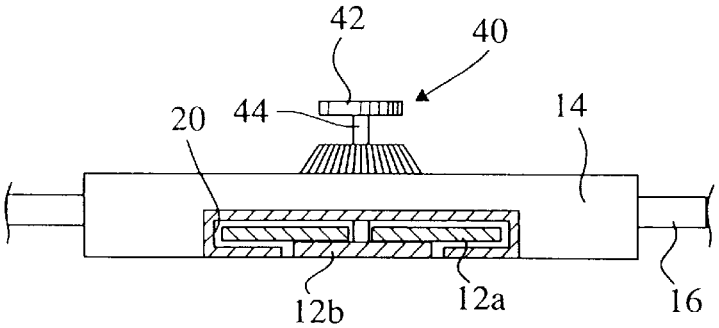
FIG. 8 is a detailed view of portion 8—8 in FIG. 7.

The connector 14 also includes a vertical channel section 24, which is sufficiently deep to allow the vertical bar 16 to slide within the channel section 24 above the horizontal bar 12, as seen particularly well in FIGS. 3 and 5. It will be appreciated that the horizontal bar 12 and the vertical bar 16 slide independently of each other in the horizontal channel section 20 and the vertical channel section 24, respectively. The vertical bar 16 includes an enlarged portion 16*a* proximate to the bottom thereof and a flange 16*b* proximate to the top thereof. As best seen in FIG. 7, the enlarged portion 16*a*, the horizontal channel section 20 and the flange 16*b* are all substantially the same depth, so that their rear surfaces lie substantially in a plane to provide a firm foundation for the device 10 when it is placed against the wall W.

The horizontal and vertical bars 12 and 16 may be constructed of variable lengths depending on the amount adjustment in these directions desired, as will be clearer from the description that follows. These bars should be constructed to render them sufficiently strong and stiff to support the desired load. For example, the vertical bar 16 can be molded as a channel to impart greater rigidity (see FIG. 5). The vertical and horizontal bars, as well as that of the other components of the hanging device of the present invention, can be made as strong as is necessary to carry a particular weight without deforming. It will be appreciated that the hanging device can be made according to different load ratings, which can be stamped on the device or included in packaging so that consumers can chose a device that has a strength rating compatible with its intended use.

The object to be supported, such as a picture, is hung from the hooks 30 at opposing ends of an arm 32 formed integrally with and at the top of the vertical bar 16. The hooks 30 can be molded integrally with the flange 16*b* to increase their rigidity. The arm 32 extends horizontally from and is centered on the vertical bar 16. The hooks 30 together support a wire or cord attached in a conventional manner to the object being hung. Thus, the present invention makes it possible to employ conventional mounting arrangements and does not require special structure to provide an adjustable hanging device.

As best seen in FIG. 7, the outer portion 30*a* of the each hook 30 extends out from the wall sufficiently to engage a cord or wire on the picture or object to be hung. The inner portion of the hook 30*b* is angled to form a "V" with the outer portion 30*a* to assist in guiding the wire/cord into the "V" for support by the device 10.

Figure 4:
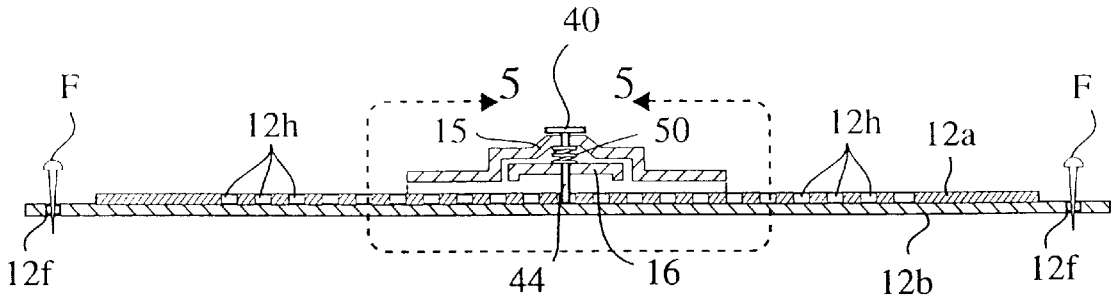
FIG. 4 is a cross-section taken through line 4—4 in FIG. 2
Figure 6:
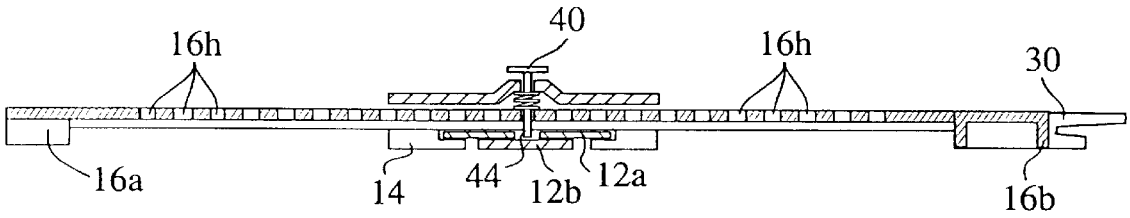
FIG. 6 is a cross-section taken through line 6—6 of FIG. 2.

The top section 12*a* of the horizontal bar 12 has equally spaced holes 12*h* through it. The holes 12*h* are closed by the bottom section 12*b*, as best seen in FIGS. 4 and 5. The vertical bar 16 has holes 16*h* through it, as best seen in FIG. 6. The holes 12*h* and 16*h* are generally along the center of the bars 12 and 16, respectively. A pin 40 is mounted in a hole 14*h* in the top of the connector 14. (See also FIG. 3.) The pin 40 includes a head portion 42 and a shaft 44. The shaft 44 passes through the holes 16*h* and 12*h* when they are aligned (see FIGS. 4 to 6) to fix the horizontal bar 12 and the vertical bar 16 in place.

The pin 40 is spring-biased into its locking position by a compression spring 50 that fits between the connector 14 and the vertical bar 16, as seen most clearly in FIG. 5. The spring 50 is compressed between a raised collar 15 on the connector 14 and a bearing ring 45 on the shaft 44 of the pin 40. The collar 15 provides sufficient space for the spring between the vertical bar 16 and the inside of the connector 14. It will be appreciated that the pin 40 may be retracted against the force of the spring 50 by pulling on the head 42, thereby withdrawing the shaft 44 from the holes 12*h* and 16*h*. This allows the horizontal bar 12 and the vertical bar 16 to slide unimpeded within the connector 14.

Figure 2:
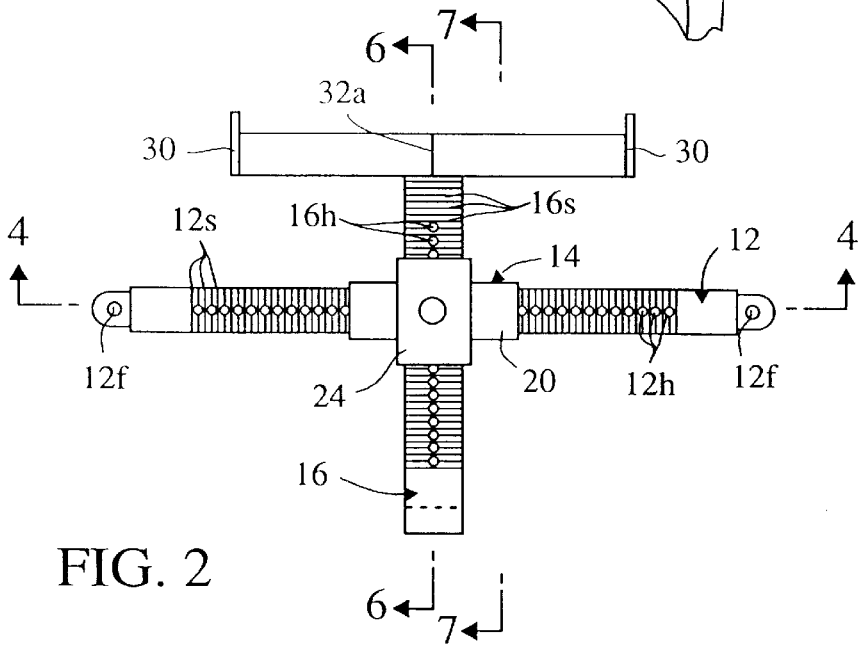
FIG. 2 is a top plan view of the wall hanger shown in FIG. 1.

A vertical mark 32*a* at the centerline of the arm 32 (and the vertical bar 16) will aid in aligning the hooks 30 with a mark M made on the wall by the person hanging the object. The mark M will most typically be the approximate location of the apex of the wire or cord on the object when the wire or cord is pulled taut toward the top of the object. Scribe marks 12*s* and 16*s* (FIGS. 1 and 2) at regular intervals on the horizontal bar 12 and the vertical bar 16, respectively, aid in gauging the amount of adjustment required as the bars 12 and 16 are slid relative to one another within the connector 14. In operation, a user determines the approximate position he or she wants the object being hung to occupy and places a light mark M on the wall W, as noted above. Each end of the horizontal bar 12 has fastening holes 12*f*. The user aligns the mark 32*a* on the arm 32 with the mark M on the wall W, and fastens the device 10 to the wall with suitable fasteners F accepted through the holes 12*f*. A portion of the underside of the ends of the horizontal bar 12 facing the wall W can be treated with a double-stick adhesive to temporarily affix the device to the wall while it is being permanently fastened using the fasteners F. The user then hangs the object on the hooks 30. If the object is not in the exact position desired by the user, he or she simply grasps the head of the pin 40 and releases the vertical and/or horizontal bars so they can slide in the connector 14. Using the scored lines 12*s* and 16*s*, the bars 12 and 16 can be adjusted the proper amount to bring the object to the exact position desired by the user.

From the above description, it will be appreciated that the unique advantages of the present invention are provided by the features discussed above, among them being:

1. A sliding connector that can be moved along a horizontal bar affixed to a supporting structure and that mounts a vertical bar for movement relative to the horizontal bar, for enabling precise positioning of the object to be hung.
2. A mechanism, such as the spring-loaded pin discussed above or other suitable arrangement, that secures the movable bars in desired fixed positions after they are properly positioned.
3. Marks on the adjustable horizontal and vertical bars to aid in precise placement of the object being hung.
4. Two object-supporting hooks on the same arm, thus enabling the hooks to remain in horizontal and vertical alignment to each other and facilitate leveling of the object being hung. By using two hooks, a picture or other object being hung by a wire that passes over the hooks is held more stably in the desired position.
5. Adhesive on the back of the bar affixing the device to the supporting structure to temporarily hold the device in place until it can be permanently fastened to the supporting structure, thus eliminating the need for the user to hold the device in place while it is being permanently fastened to the supporting structure. Preferably, the adhesive will be of a type that will not permanently adhere to the wall and potentially damage the finish thereon if it is ever desired to remove the device.

While preferred embodiments of the invention have been depicted and described, it will be understood that various changes and modifications can be made other than those specifically mentioned above without departing from the spirit and scope of the invention, which is defined solely by the claims that follow.

In this respect, it is to be understood that the invention is not limited in its application to the details of construction and to the arrangements of the components set forth in the above description or illustrated in the drawings. The invention is capable of other embodiments and of being practiced and carried out in various ways. For example, the means for accepting fasteners to secure the horizontal bar to a supporting structure need not be holes that accept nails or screws, as discussed above. Such means can assume any form that enables the bar to be attached to the supporting structure. The same is true of the means on the vertical bar for accepting the object to be hung. That is, such means need not be hooks as shown above, but can assume any form that enables the object to be attached to the vertical bar. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

What is claimed is:

1. A device for hanging an object on a supporting structure, the device comprising:

a first bar for affixing the device to the supporting structure;

a second bar for supporting the object; and a connector movably supported by said first bar for adjustment of the position of said connector when said first bar is affixed to the supporting structure and movably supporting said second bar for relative movement transverse to said first bar when said first bar is affixed to the supporting structure, wherein said first bar and second bar overlap at said connector and said connector includes a fixing mechanism for securing said first bar and said second bar in fixed positions relative to each other after movement thereof to desired positions.

2. A device as in claim 1, wherein:

said connector includes a first channel slidably supported on said first bar when said first bar is affixed to the supporting structure and a second channel for slidably supporting said second bar for movement perpendicular to said first bar;

said first bar includes at each end thereof means for cooperating with a fastener for securing said first bar to the supporting structure in a horizontal orientation; and said second bar includes proximate to a top end thereof means for accepting the object to be hung.

3. A device as in claim 2, wherein:

said first bar and said second bar have openings extending therealong in a longitudinal direction; and said fixing mechanism comprises a pin mounted on said connector for entering said openings to lock said bars against movement relative to each other and said connector.

4. A device as in claim 3, wherein said pin is spring-biased into a locking position and includes a knob for manually extracting said pin from said openings against the bias of said spring.

5. An adjustable device for hanging a wire-supported object on a wall, the device comprising:

a first bar for positioning horizontally against the wall, said first bar including attaching means allowing said first bar to be affixed to the wall at a desired location;

a second bar including at least one hook for accepting a wire secured to the object to be hung;

a connector connecting said first bar and said second bar for movement relative to each other, said connector including a first channel in which said first bar is mounted for permitting sliding movement of said connector along said first bar when said first bar is affixed to the wall and a second channel in which said second bar is mounted for sliding movement perpendicular to said first bar at a location spaced from the wall when the first bar is affixed to the wall;

a fixing mechanism on said connector for securing said first bar and said second bar in fixed positions relative to each other after movement thereof to desired positions.

6. An adjustable wall-hanging device as in claim 5, wherein:

said first channel includes an open slot at a side adapted to face the wall when said first bar is affixed to the wall;

said first bar includes a top portion captured in said channel and a bottom portion accessible through said slot, wherein said first bar is adapted to be affixed to the wall with said bottom portion in contact with the wall;

said second bar and said top portion of said first bar include plural openings disposed therealong at regular intervals;

said fixing mechanism includes a pin mounted for axial movement in said connector, a spring biasing said pin into said openings to lock said first bar and said second bar into fixed positions, and a knob for pulling said pin axially against the force of said spring to disengage said pin from said openings and permit relative movement of said first and second bars and said connector.

7. An adjustable wall hanging device as in claim 6, wherein said top portion and said bottom portion of said first bar are separate members.

8. An adjustable wall hanging device as in claim 6, wherein said top portion and said bottom portion of said first bar are integrally formed as one piece.

9. An adjustable wall hanging device as in claim 6, wherein said second bar includes an arm at an end of said second bar, said arm being at the top of said second bar when said first bar is affixed to the wall, and said arm includes one said hook at each end thereof.

10. An adjustable wall hanging device as in claim 9, wherein said first bar and said second bar have locating indicia at regular intervals therealong and said arm has a locating indicia at a center thereof.

* * * * *